US008891808B2

(12) United States Patent
Yan

(10) Patent No.: US 8,891,808 B2
(45) Date of Patent: Nov. 18, 2014

(54) MICRO-SPEAKER

(71) Applicant: Xudong Yan, Shenzhen (CN)

(72) Inventor: Xudong Yan, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 13/751,424

(22) Filed: Jan. 28, 2013

(65) Prior Publication Data

US 2013/0259290 A1 Oct. 3, 2013

(30) Foreign Application Priority Data

Apr. 3, 2012 (CN) ..... 2012 2 0140601 U
Apr. 23, 2012 (CN) ..... 2012 2 0174564 U

(51) Int. Cl.
*H04R 25/00* (2006.01)

(52) U.S. Cl.
USPC ..... 381/398; 381/396; 381/433

(58) Field of Classification Search
USPC ..... 381/396, 398–399, 400, 404, 312, 381/423–426, 431, 433
See application file for complete search history.

(56) References Cited

U.S. PATENT DOCUMENTS 6,219,431 B1 * 4/2001 Proni ..... 381/397
8,111,868 B2 * 2/2012 Kaiya ..... 381/396

* cited by examiner

*Primary Examiner* — Suhan Ni
(74) *Attorney, Agent, or Firm* — Anova Law Group, PLLC

(57) ABSTRACT

Disclosed is a micro-speaker. The micro-speaker includes a frame, a magnetic circuit unit assembled with the frame, a diaphragm extending along a longitudinal direction, a coil, an elastic member and an FPC. The diaphragm includes a top plate and a periphery portion surrounding the top plate. The top plate includes a supporting portion extending from the top plate towards the base wall of the frame and disposed at a periphery portion of the top plate in the longitudinal direction. The elastic member includes an elastic part, a first end connecting to the supporting portion of the diaphragm and a second end connecting to the frame.

13 Claims, 2 Drawing Sheets

MICRO-SPEAKER

FIELD OF THE INVENTION

The present disclosure relates to the art of speakers, particularly to a micro-speaker used in an electronic device.

DESCRIPTION OF RELATED ART

Micro-speakers have been widely used in portable electronic devices in daily life and in industry, such as cellular phones, notebooks, and so on.

A related micro-speaker comprises a frame, a diaphragm attached to the frame, and a coil connected to the diaphragm. To meet the development of multiple kinds of acoustic and communication equipments with a thin configuration and a big screen, the related speaker embedded in the equipments is requested to be more thin and have a slight outline. The diaphragm of the related speaker also has a slight outline with a long side and a short side, and a length of the long side is greater than several times of the short side.

However, the long side of the diaphragm suffers a greater force than the short side while the coil actuates the diaphragm to vibrate, which causes an unbalanced vibration of the diaphragm that may influence the performance of the speaker and damage the diaphragm.

Therefore, it is desirable to provide a micro-speaker which can overcome the above-mentioned problems.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
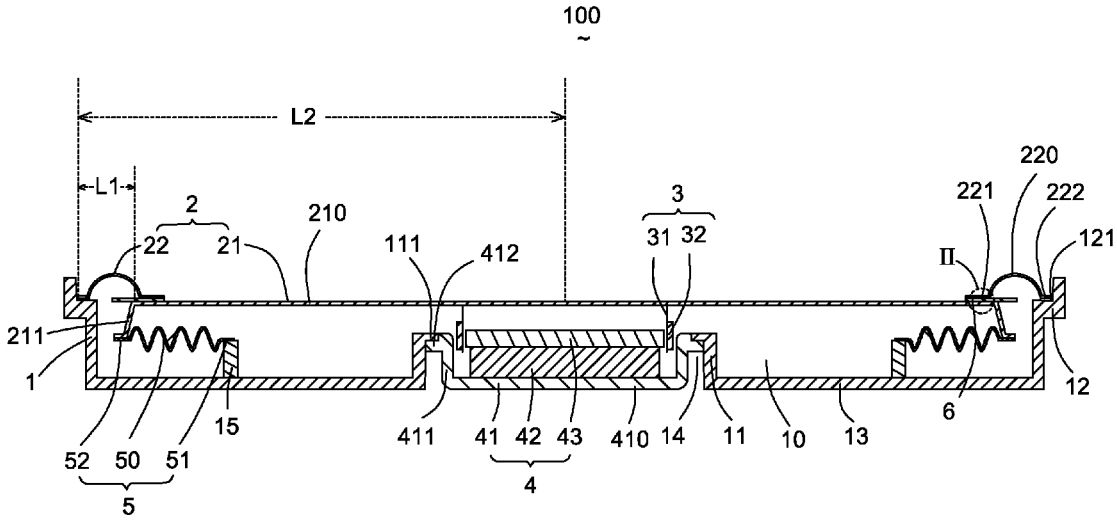
FIG. 1 is cross-sectional view of a micro-speaker according to a first embodiment of the present disclosure.
Figure 2:
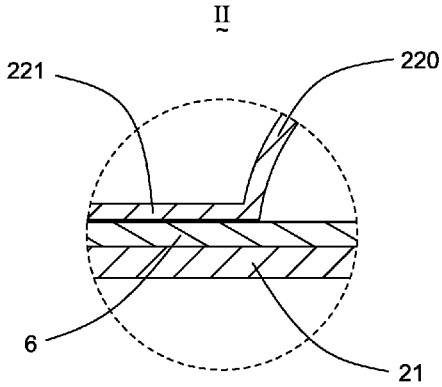
FIG. 2 is an enlarged view of part II in FIG. 1.

Referring to FIGS. 1-2, a micro-speaker 100 according to a first embodiment of the present disclosure comprises a frame 1, a magnetic circuit unit 4 accommodated in the frame 1, a diaphragm 2, a coil assembly 3 and an elastic member 5.

The frame 1 has a slight configuration extending along a longitudinal direction and includes an inner wall 11, an outer wall 12 surrounding the inner wall 11, and a base wall 13 connected the inner wall 11 and the outer wall 12. The inner wall 11 forms a receiving space 14 for receiving the magnetic circuit unit 4. The outer wall 12 includes a step portion 121 disposed at a top end of the outer wall 12.

The magnetic circuit unit 4 includes a yoke 41 provided with a base 410 and a side wall 411 extending from the base 410, a magnet 42 disposed on the base 410 of the yoke 41, and a pole plate 43 disposed on the magnet 42. The yoke 41 further includes a protruding portion 412 extending from the side wall 411 towards the inner wall 11. The inner wall 11 includes a position portion 111 extending towards the magnetic circuit unit 4 and engaged with the position portion 111 of the inner wall 11. In this embodiment, the position portion 111 is supported by the protruding portion 412. The yoke in FIG. 1 is bowl-shaped and includes a base and a side wall extending from the base. However, it is optional that the yoke is a panel without the sidewall. The panel itself carries the magnet thereon. In the embodiment, a magnetic gap is formed between the sidewall 411 and the magnet 42 for at least partially receiving the coil assembly 3. When the yoke is a panel, the magnetic gap may be formed by two magnets spaced from each other.

The diaphragm 2 has a slight configuration extending along the longitudinal direction. The diaphragm 2 includes a top plate 21 and a periphery portion 22 surrounding the top plate 21. The periphery portion 22 includes a main body 220 with a curved surface, an first plate 221 disposed at an inner circumference of the main body 220, and a second plate 222 disposed at an outer circumference of the main body 220. The first plate 221 is attached to the top plate 21, and the second plate 122 is attached to the step portion 121 of the outer wall 12 of the frame 1 for sustaining the diaphragm 2 to the frame 1. The frame 1, the diaphragm 2 and the magnetic circuit unit 4 cooperatively form a chamber 10.

The coil assembly 3 includes a bracket 31 with one end attached to the diaphragm 2 directly or indirectly, and a coil 32 wound around the other end of the bracket 32. The coil 32 is ring shaped and disposed in the magnetic gap formed by the magnetic circuit unit 4. The coil 32 is capable of vibrating and actuating the diaphragm 2 to vibrate and generate sound. In other embodiment, the bracket 31 is optional and the coil assembly 3 is directly wound by conductive wires.

While the diaphragm 2 vibrates simultaneously with the coil 32, a central portion of the diaphragm 2 close to the coil 32 is easy to vibrate. This kind of diaphragm causes unbalanced vibration because the two ends of the diaphragm 2 in the longitudinal direction are far away from the coil assembly 3, and it is hard to actuate the two ends to vibrate.

In order to solve the problem mentioned above, two elastic members 5 are provided to support the ends of the diaphragm 2 in the longitudinal direction. The elastic member 5 is disposed within the chamber 10 and includes an elastic part 50, a first end 51 and a second end 52 respectively extending from two ends of the elastic part 50. The elastic member 5 is made from elastic material.

The top plate 21 of the diaphragm 2 includes a vibrating plate 210, and a supporting portion 211 extending from the top plate 21 towards the base wall 13 of the frame 1 and disposed at a periphery portion of the top plate 21 in the longitudinal direction. The supporting portion 211 extends and is bent from one end of the vibrating plate 210.

The frame 1 further includes a block 15 protruding from the base wall 13 and disposed between the outer wall 12 and the magnetic circuit unit 4. The elastic member 5 is retained between the supporting portion 211 and the block 15 with the first end 51 supported by the block 15 and the second end 52 supporting the supporting portion 211.

A first distance L1 is defined between an outer end of the diaphragm 2 and an outer end of the vibrating plate 210. A second distance L2 is defined between the outer end of the diaphragm 2 and a geometric center of the diaphragm 2. The first distance L1 is 10%-30% of the second distance L2 so that the end of the diaphragm 2 is supported by the elastic member 5 and easy to be actuated by the coil 32.

The speaker 100 further comprises a FPC 6 disposed between the top plate 21 and the periphery portion 22 for electrically connecting wires of the coil 3 to an external circuit. Therefore, the wires of the coil 3 do not need to extend across the periphery portion 22 to connect to the external circuit, which protects the wires of the coil 32 from damages while the diaphragm 2 vibrates.

Figure 3:
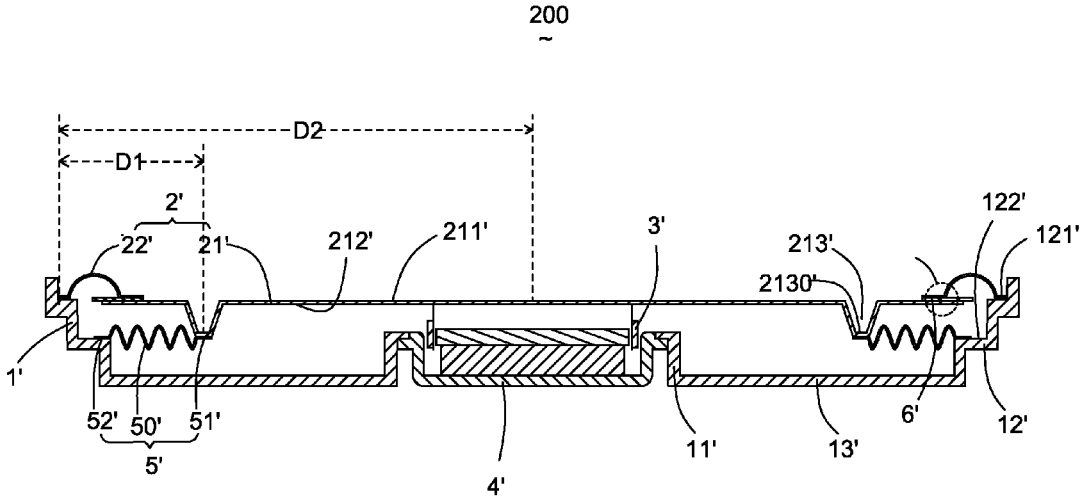
FIG. 3 is a cross-sectional view of a micro-speaker according to a second embodiment of the present disclosure.

Referring to FIG. 3, a micro-speaker 200 according to a second embodiment of the present disclosure comprises a frame 1', a diaphragm 2', a magnetic circuit unit 4', a coil assembly 3', an elastic member 5', and an FPC 6'.

The frame 1' has a slight configuration extending along a longitudinal direction and includes an inner wall 11', an outer wall 12' surrounding the inner wall 11', and a base wall 13' connecting with the inner wall 11' and the outer wall 12'. The inner wall 11' forms a receiving space 14' for receiving the magnetic circuit unit 4'. The outer wall 12' includes a first step portion 121' disposed at a top end of the outer wall 12' and a second step portion 122' connecting the first step portion 121' to the base wall 13'.

The diaphragm 2' has a slight configuration extending along the longitudinal direction. The diaphragm 2' includes a top plate 21' and a periphery portion 22' surrounding the top plate 21'. An outer end of the periphery portion 22' is attached to the first step portion 121' and an inner end thereof is connected to the top plate 21'. The top plate 21' includes an upper surface 211' and a lower surface 212' opposite to the upper surface 211'. The top plate 21' further includes a supporting portion 213' extending towards the base wall 13' of the frame. The supporting portion 213' is a concavity depressed along a direction from the upper surface 211' to the lower surface 212' and includes a bottom surface 2130'.

The elastic member 5' is retained between the supporting portion 213' and the frame 1'. The elastic member 5' includes a first end 51' connected to the bottom surface 2130' of the supporting member 213', a second end 52' supported by the second step portion 122' of the frame 1', an elastic part 50' located between the supporting portion 213' and the outer wall 12'.

A first distance D1 is defined between an outer end of the diaphragm 2' and the bottom surface 2130'. A second distance D2 is defined between the outer end of the diaphragm 2' and a geometric center of the diaphragm 2'. The first distance L1 is 20%-30% of the second distance L2 so that the end of the diaphragm 2' is supported by the elastic member 5' and easy to be actuated by the coil' 32.

It will be understood that the above-mentioned particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A micro-speaker, comprising a frame including an inner wall forming a receiving space, an outer wall surrounding the inner wall and a base wall connecting the inner wall and the outer wall;

a magnetic circuit unit assembled with the frame and accommodating in the receiving space;

a diaphragm supported by the frame, including a top plate and a periphery portion surrounding the top plate, the top plate including a supporting portion extending from the top plate towards the base wall of the frame and disposed at a periphery portion of the top plate;

a coil assembly for driving the diaphragm to vibrate;

an elastic member disposed within the frame, including an elastic part, a first end connecting to the supporting portion of the diaphragm and a second end connecting to the frame;

an FPC disposed between the top plate and the periphery portion for electrically connecting the coil assembly;

wherein the top plate further includes a vibrating plate, the supporting portion extends and is bent from one end of the vibrating plate towards the base wall of the frame; and wherein the frame further includes a block protruding from the base wall and disposed between the supporting portion and the inner wall.

2. The micro-speaker as claimed in claim 1, wherein the first end of the elastic member is supported by the block, and the second end of the elastic member is connected to a lower end of the supporting portion of the diaphragm.

3. The micro-speaker as claimed in claim 1, wherein a first distance between an outer end of the diaphragm and the end of the vibrating plate is 10%-30% of a second distance between the outer end of the diaphragm and a geometric center of the diaphragm.

4. The micro-speaker as claimed in claim 1, wherein the top plate includes an upper surface and a lower surface opposite to the upper surface, the supporting portion is a concavity depressed from the upper surface to the lower surface and includes a bottom surface.

5. The micro-speaker as claimed in claim 4, wherein the first end of the elastic member is connected to the bottom surface of the supporting member, the second end of the elastic member is supported by a second step portion formed on the outer wall of the frame, the elastic part of the elastic member is located between the supporting portion and the outer wall.

6. The micro-speaker as claimed in claim 4, wherein a first distance between an outer end of the diaphragm and the bottom surface of the supporting portion is 20%-30% of a second distance between the outer end of the diaphragm and a geometric center of the diaphragm.

7. The micro-speaker as claimed in claim 1, wherein the magnetic circuit unit includes a yoke with a base, a side wall extending from the base and a protruding portion extending from the side wall towards the inner wall of the frame.

8. The micro-speaker as claimed in claim 7, wherein the inner wall of the frame includes a position portion engaged with the protruding portion.

9. A micro-speaker, comprising a frame forming a receiving space and a bottom wall;

a magnetic circuit unit accommodating in the receiving space;

a diaphragm supported by the frame, the diaphragm including a supporting portion extending toward the bottom wall and located in the receiving space;

a coil assembly for driving the diaphragm to vibrate;

an elastic member positioned in the receiving space with an end thereof connecting to the supporting portion of the diaphragm, and another end connected to the frame;

an FPC attached to the diaphragm and electrically connecting with the coil assembly;

wherein the diaphragm includes a top plate and a curved periphery surrounding the top plate, the supporting portion locates below the curved periphery; and wherein the frame further includes a block extending from the bottom toward the diaphragm, the block located between the magnetic circuit unit and the supporting portion, and the elastic member connected to the supporting portion and the block.

10. The micro-speaker as claimed in claim 9, wherein the diaphragm includes two supporting portions located adjacent to the periphery of the diaphragm.

11. The micro-speaker as claimed in claim 10, wherein a first distance between an edge of the diaphragm to the supporting portion is 10%-30% of a second distance between the edge of the diaphragm and a geometric center of the diaphragm.

12. The micro-speaker as claimed in claim 9, wherein the supporting portion is a depressed portion extending from the diaphragm, and the elastic member locates between the depressed portion and a side of the frame.

13. The micro-speaker as claimed in claim 12, wherein the side of the frame includes a first step portion for supporting the diaphragm, and a second step portion for connecting with the elastic member.

* * * * *